US008646647B2

(12) United States Patent
Yao

(10) Patent No.: US 8,646,647 B2
(45) Date of Patent: Feb. 11, 2014

(54) STRAW-LOOSENING-PREVENTION LID

(71) Applicant: Li-Ho Yao, Taipei (TW)

(72) Inventor: Li-Ho Yao, Taipei (TW)

( * ) Notice: Subject to any disclaimer, the term of this patent is extended or adjusted under 35 U.S.C. 154(b) by 0 days.

(21) Appl. No.: 13/629,707

(22) Filed: Sep. 28, 2012

(65) Prior Publication Data

US 2013/0087571 A1 Apr. 11, 2013

(30) Foreign Application Priority Data

Oct. 6, 2011 (TW) ..... 100218729 U

(51) Int. Cl.
*A47G 19/22* (2006.01)
*A47G 21/18* (2006.01)

(52) U.S. Cl.
CPC ..... *A47G 19/2222* (2013.01); *A47G 21/18* (2013.01)
USPC ..... 220/709; 215/229

(58) Field of Classification Search
CPC ... A47G 19/22; A47G 21/18; A47G 19/2222; A47G 21/186; B65D 77/28
USPC ..... 220/709, 707, 705, 703, 212; 215/229, 215/228, 200
IPC ..... A47G 19/22, 21/18
See application file for complete search history.

(56) References Cited

U.S. PATENT DOCUMENTS 3,048,317 A * 8/1962 Cochrane et al. ..... 229/103.1
3,295,715 A * 1/1967 Pugh ..... 220/212
3,478,922 A * 11/1969 Mole ..... 220/86.2
3,524,566 A * 8/1970 Parks ..... 220/268
3,822,030 A * 7/1974 Tanzer ..... 220/709
3,874,554 A * 4/1975 Chang ..... 220/708
4,074,827 A * 2/1978 Labe, III ..... 220/522
4,948,009 A * 8/1990 Sawatani ..... 220/229
5,025,947 A * 6/1991 Leone ..... 220/229
5,054,684 A * 10/1991 Farber et al. ..... 229/103.1
5,147,065 A * 9/1992 Rush et al. ..... 220/709
5,147,337 A * 9/1992 Plone ..... 604/306
5,425,471 A * 6/1995 Wendt ..... 220/705
5,518,143 A * 5/1996 Iodice ..... 220/708
6,357,619 B1 * 3/2002 Schaefer ..... 220/709
2004/0245250 A1 * 12/2004 Hidalgo et al. ..... 220/229
2005/0230402 A1 * 10/2005 Greenberg ..... 220/705
2012/0273500 A1 * 11/2012 Yao ..... 220/521

* cited by examiner

*Primary Examiner* — Robert J Hicks

(74) *Attorney, Agent, or Firm* — Alan Kamrath; Kamrath IP Lawfirm, P.A.

(57) ABSTRACT

A straw-loosening-prevention lid has a body and a straw part. The straw part has a through hole, multiple abutting fins, a straw hole, a closing flake and multiple connecting contacts. Since the straw hole is surrounded by the abutting fins, a diameter of the straw hole can be smaller than a diameter of a straw. When the straw is inserted downward into the straw hole, the abutting fins are pushed by the straw, are bent downward and then clamp the straw. Afterward, when the straw is going to move upward, the friction force between the straw and the abutting fins makes the abutting fins bend upward to the original angle and clamp the straw more tightly. As a result, the straw clamped by the abutting fins is hard to move upward, which prevents the straw from slipping out easily.

16 Claims, 9 Drawing Sheets

STRAW-LOOSENING-PREVENTION LID

BACKGROUND OF THE INVENTION

1. Field of the Invention

The present invention relates to a lid for a cup and, especially, to a lid that can hold a straw securely.

2. Description of the Prior Arts

Lids are used for covering cups to keep dust from entering the cups and to prevent the liquid in the cups from spilling out. With reference to FIGS. 10 and 11, a conventional lid 90 has a straw hole 91, a closing flake 92, multiple connecting contacts 94 and a connecting segment 95. The closing flake 92 is mounted pivotally in the straw hole 91, and a diameter of the closing flake 92 is slightly smaller than a diameter of the straw hole 91. The closing flake 92 keeps dust from entering the cup before a straw 93 is inserted into the straw hole 91. The connecting contacts 94 and the connecting segment 95 are disposed between and connect respectively an annular edge around the straw hole 91 and the closing flake 92. The connecting segment 95 is larger in volume than each connecting contact 94.

When the straw 93 is inserted into the straw hole 91, the connecting contacts 94 are broken by the external force, but the connecting segment 95 still connects the closing flake 92 to keep the closing flake 92 from falling into the cup. Then, the closing flake 92 is pivoted downward.

However, when the straw 93 is inserted into the straw hole 91, the annular edge around the straw hole 91 may abut against the straw 93. The straw 93 is restricted from axial movement relative to the lid only by the friction force between the annular edge around the straw hole 91 and the straw 93. Therefore, the straw 93 is not held securely. As a result, the straw 93 may slip out when the user moves while holding the cup with the lid.

To overcome the shortcomings, the present invention provides a straw-loosening-prevention lid to mitigate or obviate the aforementioned problems.

SUMMARY OF THE INVENTION

The main objective of the present invention is to provide a lid that can hold the straw securely.

The straw-loosening-prevention lid in accordance with the present invention has a body and a straw part. The straw part has a through hole, multiple abutting fins, a straw hole, a closing flake and multiple connecting contacts. The through hole is formed through the body. The abutting fins are formed on an annular edge around the through hole and are annularly arranged separately. The straw hole is surrounded by the abutting fins. The closing flake is mounted in the straw hole. The connecting contacts are disposed between and connect respectively the closing flake and the abutting fins. One of the abutting fins connects the closing flake directly, and the other abutting fins connect to the closing flake through the connecting contacts.

Because the straw hole is surrounded by the abutting fins, a diameter of the straw hole can be smaller than a diameter of a straw. When the straw is inserted downward into the straw hole, the abutting fins are pushed by the straw, are bent downward and then clamp the straw. Afterward, when the straw is going to move upward, the friction force between the straw and the abutting fins makes the abutting fins bend upward to the original angle and clamp the straw more tightly. As a result, the straw clamped by the abutting fins is hard to move upward, which prevents the straw from slipping out easily.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
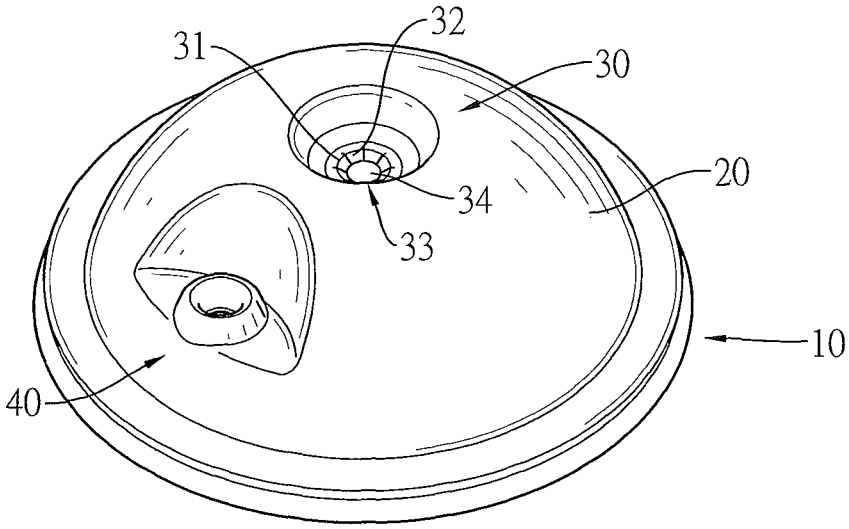
FIG. 1 is a perspective view of a straw-loosening-prevention lid of a first embodiment in accordance with the present invention.
Figure 2:
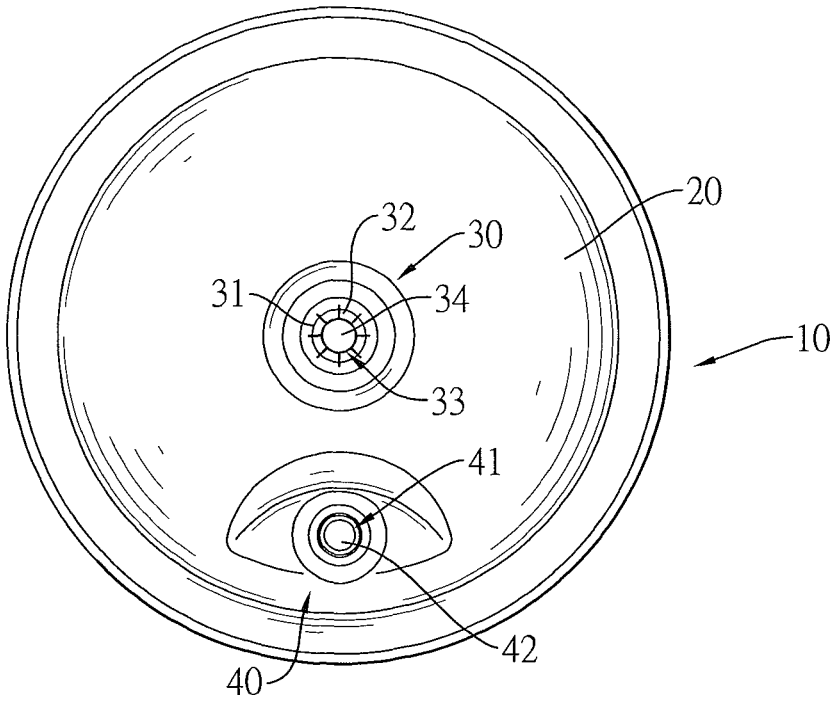
FIG. 2 is a top view of the straw-loosening-prevention lid in FIG. 1.

With reference to FIGS. 1 and 2, a first embodiment of a straw-loosening-prevention lid in accordance with the present invention comprises a body 10 and a straw part 30. In a preferred embodiment, the straw-loosening-prevention lid further comprises a spherical part 20 and a fastening part 40.

The spherical part 20 is formed on and protrudes upward from a center of the body 10.

Figure 4:
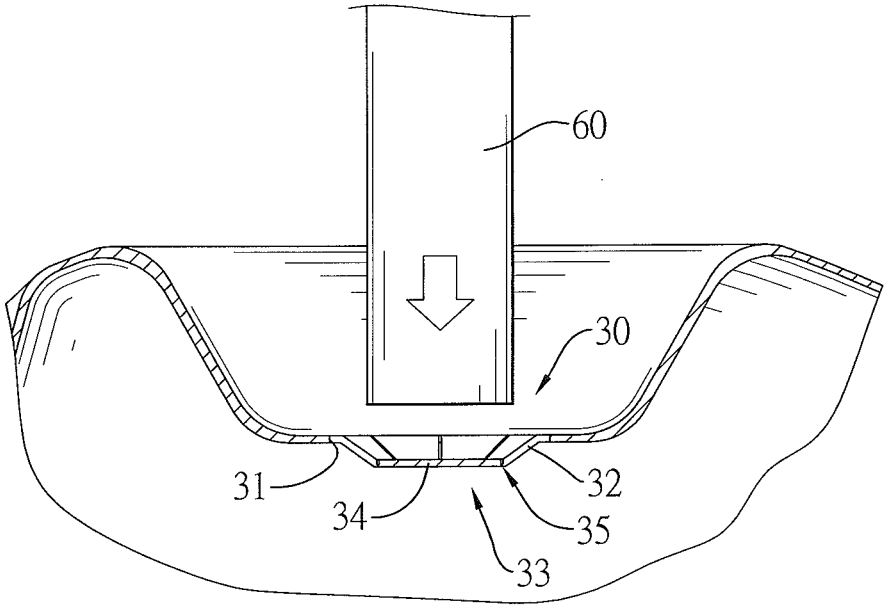
FIG. 4 is a side view in partial section of the straw-loosening-prevention lid in FIG. 1, showing the straw not inserted yet.

With reference to FIGS. 1, 2 and 4, the straw part 30 is formed on the body 10 and has a through hole 31, a straw hole 33, multiple abutting fins 32, a closing flake 34 and multiple connecting contacts 35. The through hole 31 is formed through the body 10. The abutting fins 32 are formed on an annular edge around the through hole 31, are annularly arranged separately and surround the straw hole 33. The closing flake 34 is mounted pivotally in the straw hole 33. The connecting contacts 35 are disposed between and connect respectively the closing flake 34 and the abutting fins 32. One of the abutting fins 32 connects to the closing flake 34 directly, and the other abutting fins 32 connect to the closing flake 34 through the connecting contacts 35. In a preferred embodiment, the straw part 30 is formed depressedly in the center of the spherical part 20. The through hole 31 and the straw hole 33 are circular. The abutting fins 32 incline downward toward the center.

Figure 7:
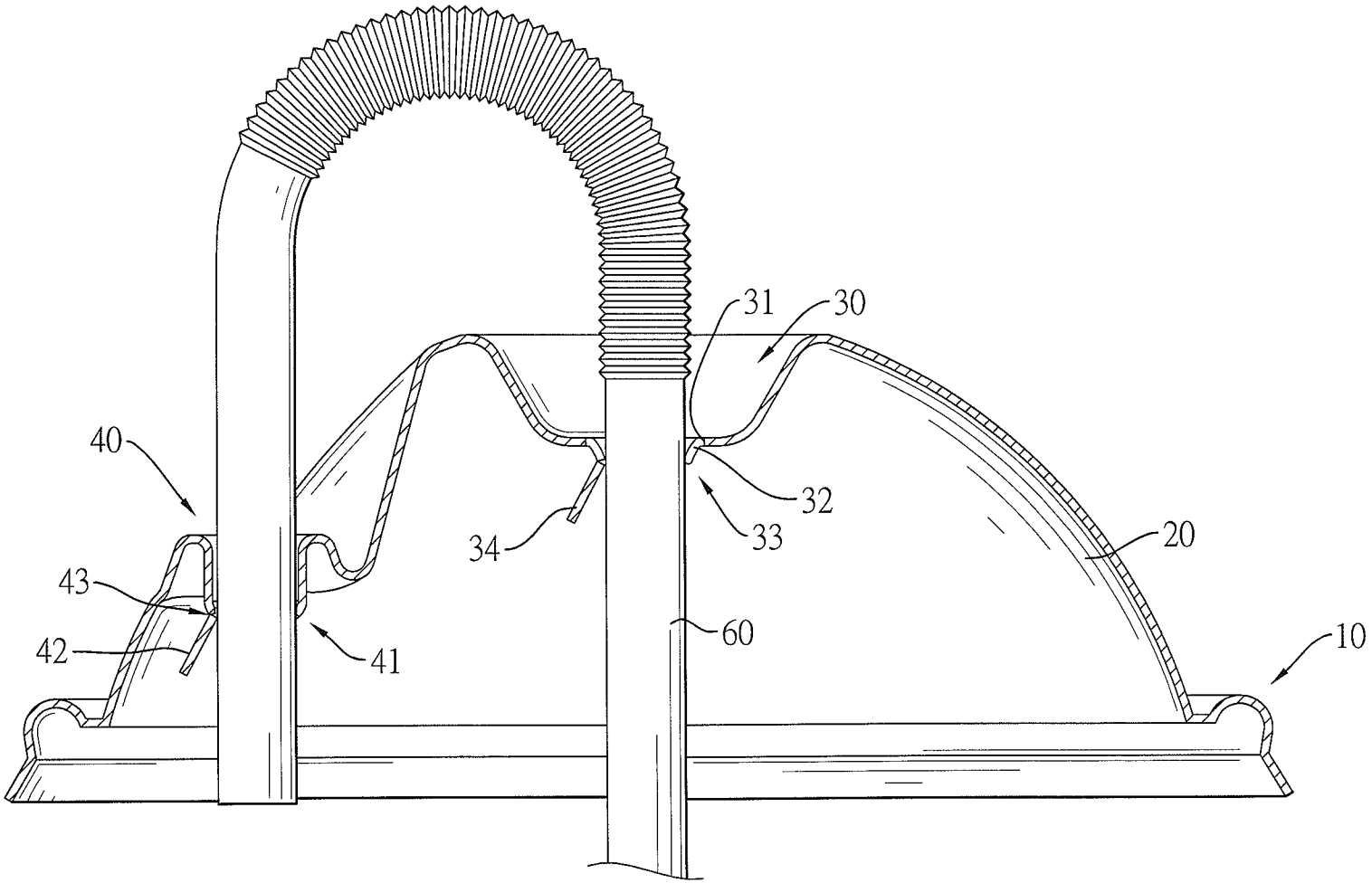
FIG. 7 is a side view in partial section of the straw-loosening-prevention lid in FIG. 1, showing the straw mounted in the fastening part.

With reference to FIGS. 1, 2 and 7, the fastening part 40 is formed depressedly in the spherical part 20 and has an accessory hole 41, a closing flake 42, multiple connecting contacts and a connecting segment 43. The accessory hole 41 is formed through the body 10, is circular, and is separate from the straw hole 33 of the straw part 30. The closing flake 42 is mounted in the accessory hole 41. The connecting contacts and the connecting segment 43 are disposed between the closing flake 42 and an annular edge around the accessory hole 41 and connect respectively the closing flake 42 and the annular edge around the accessory hole 41. The connecting segment 43 is larger in volume than each connecting contact.

Figure 3:
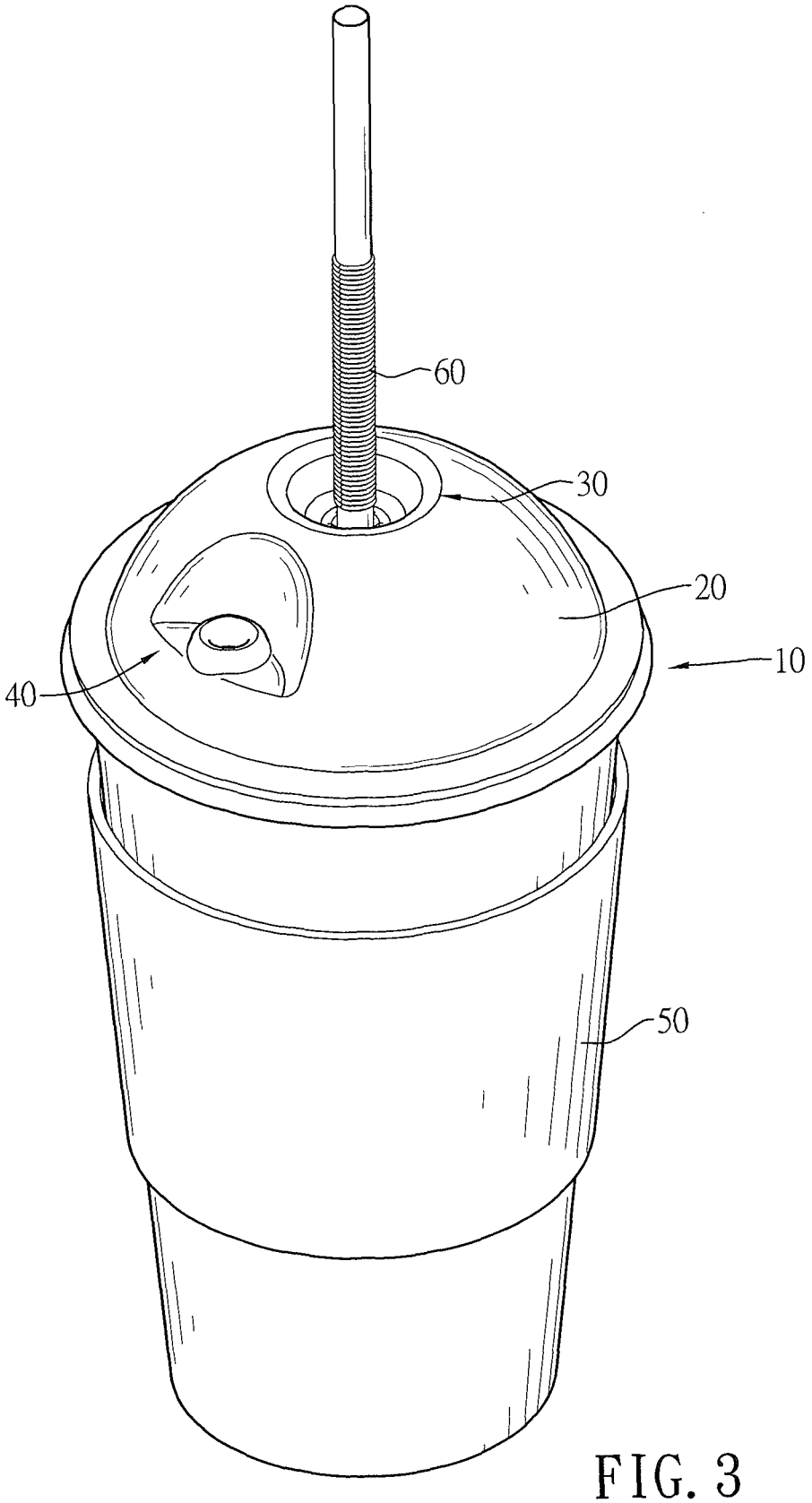
FIG. 3 is a perspective view of the straw-loosening-prevention lid in FIG. 1, showing a straw inserted.
Figure 5:
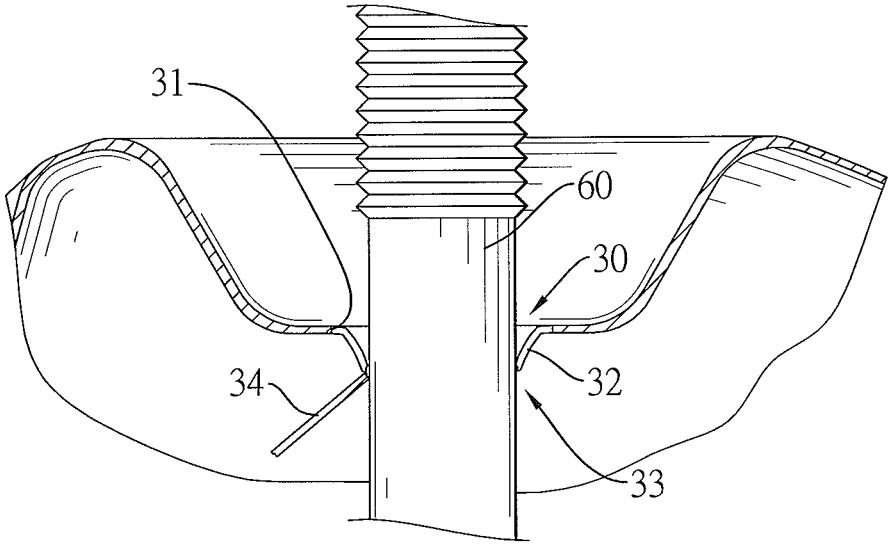
FIG. 5 is a side view in partial section of the straw-loosening-prevention lid in FIG. 1, showing the straw inserted.

With reference to FIGS. 3 to 5, when the straw-loosening-prevention lid as described is used, the body 10 is covered on a cup 50 for a straw 60 that is slightly larger in diameter than the straw hole 33 of the straw part 30. When the straw 60 is inserted downward into the straw hole 33, the straw 60 abuts the abutting fins 32 around the straw hole 33, since a diameter of the straw 60 is larger than a diameter of the straw hole 33. Then, the connecting contacts 35 between the abutting fins 32 and the closing flake 34 are all broken, and the abutting fins 32 are bent downward and clamp the straw 60. Besides, the closing flake 34 does not fall into the cup 50, because one of the abutting fins 32 connects the closing flake 34 directly.

When the straw 60 is going to move upward, the abutting fins 32 are bent upward to the original angle and clamp the straw 60 more tightly. As a result, the straw 60 clamped by the abutting fins 32 is hard to move upward, which prevents the straw 60 from slipping out easily.

Figure 6:
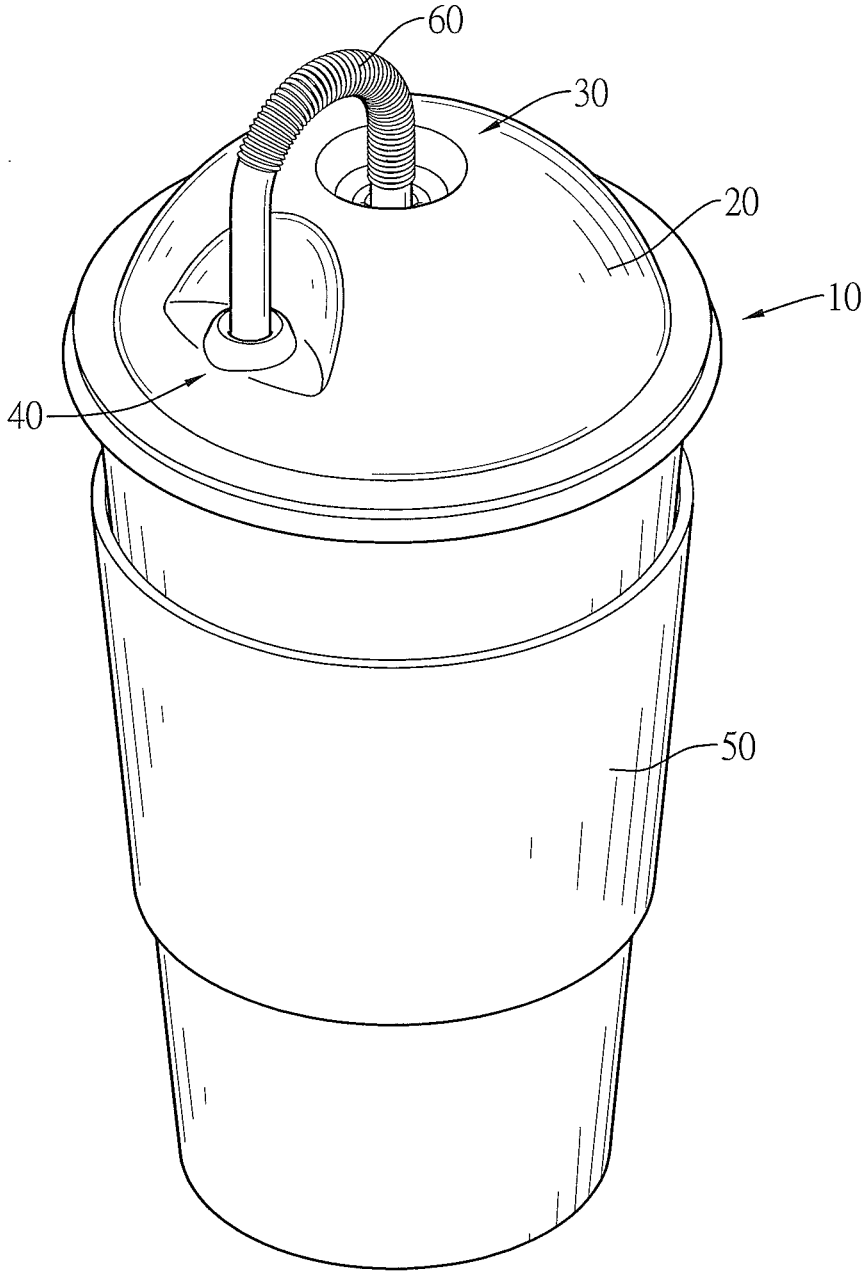
FIG. 6 is a perspective view of the straw-loosening-prevention lid in FIG. 1, showing the straw mounted in the fastening part.

With further reference to FIGS. 6 and 7, a top end of the straw 60 can be inserted into the accessory hole 41 of the fastening part 40. The diameter of the straw 60 is equal to a diameter of the accessory hole 41, so the straw 60 abuts against the closing flake 42. Then, the connecting contacts between the accessory hole 41 and the closing flake 42 are all broken, and the closing flake 42 bends downward so that the straw 60 can pass through the accessory hole 41. Besides, the connecting segment 43 is not broken and still connects the closing flake 42 to prevent the closing flake 42 from falling into the cup.

When the user temporarily does not use the straw 60, the top end of the straw 60 can be inserted into the fastening part 40, which not only further fastens the straw 60 to prevent the straw 60 from slipping out easily, but also keeps the top end of the straw 60 in a sanitary condition.

Figure 8:
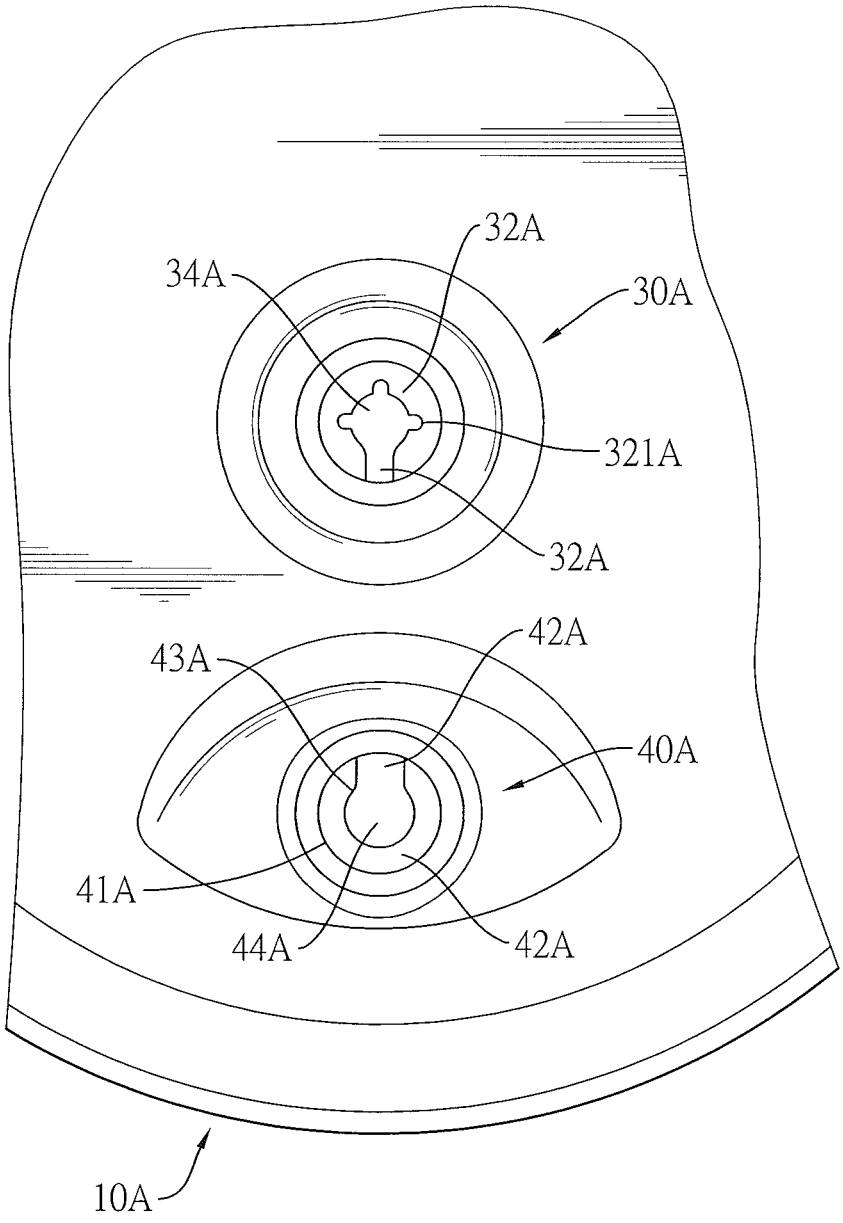
FIG. 8 is an enlarged top view of a straw-loosening-prevention lid of a second embodiment in accordance with the present invention.
Figure 9:
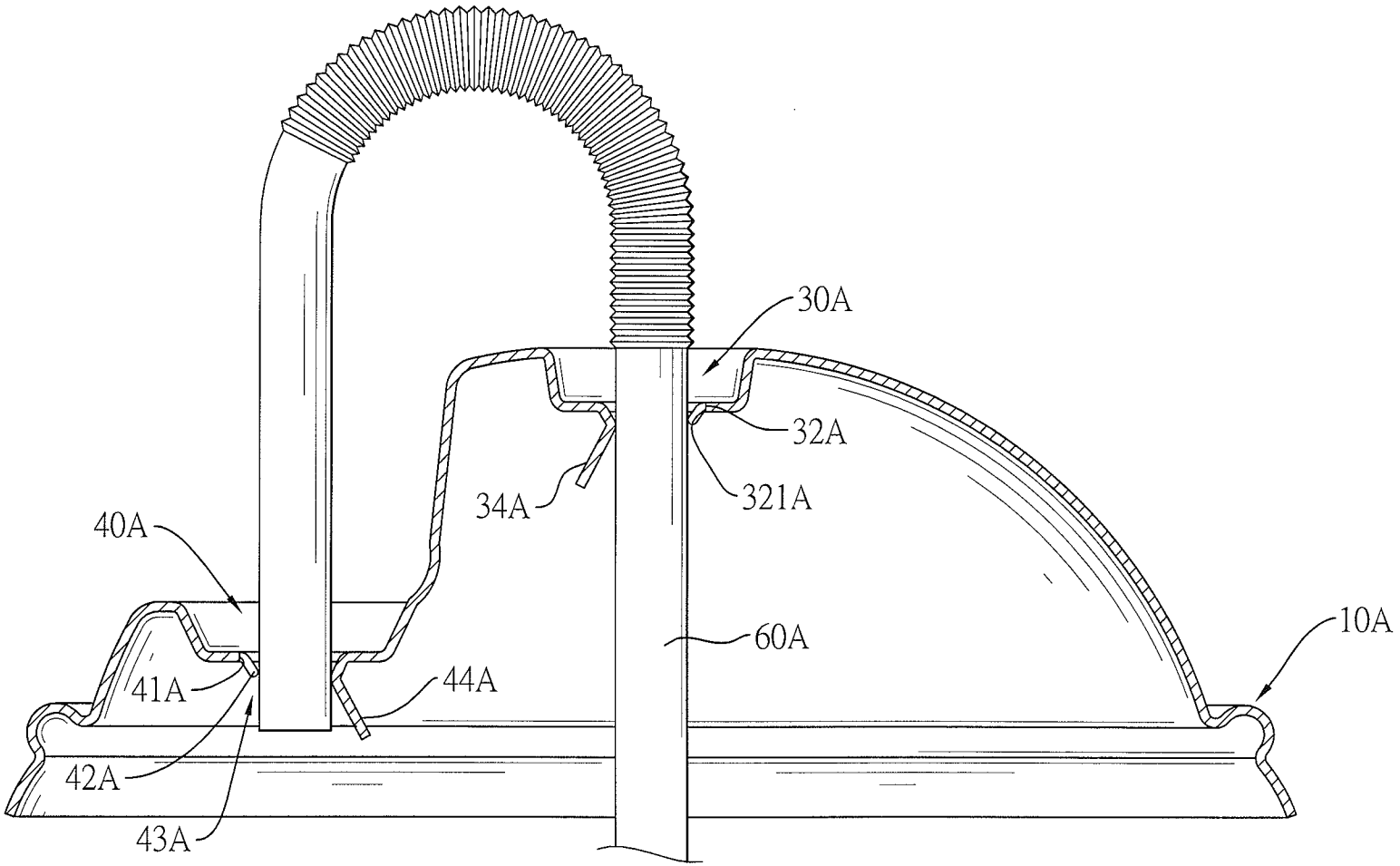
FIG. 9 is a side view in partial section of the straw-loosening-prevention lid in FIG. 8, showing the straw inserted.
Figure 10:
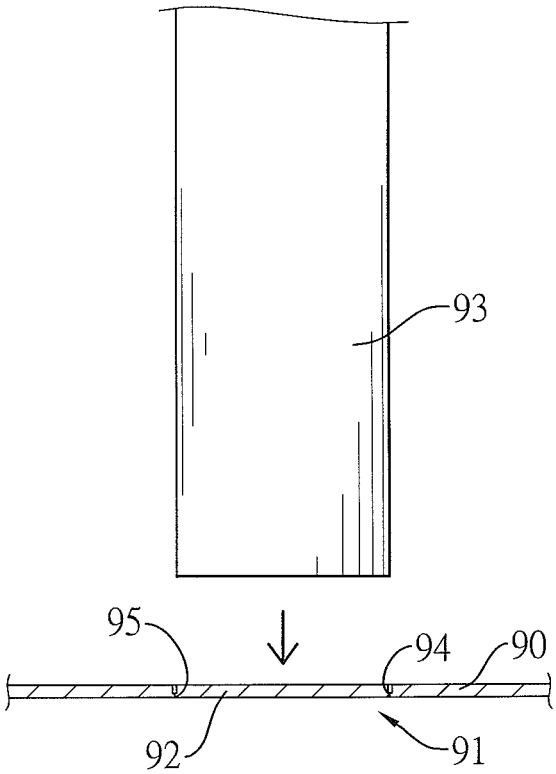
FIG. 10 PRIOR ART
FIG. 10 is a side view in partial section of a lid in accordance with the prior art, showing the straw not inserted yet.
Figure 11:
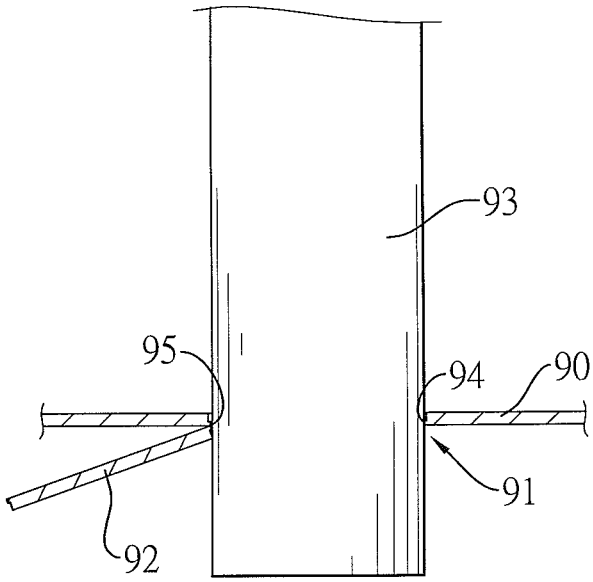
FIG. 11 PRIOR ART
FIG. 11 is a side view in partial section of the lid in FIG. 10, showing the straw inserted.

With reference to FIGS. 8 and 9, a second embodiment of the straw-loosening-prevention lid in accordance with the present invention is similar to the first embodiment as described above. However, the two embodiments have the following difference.

The straw part 30A has two abutting fins 32A. One of the abutting fins 32A directly connects to the closing flake 34A, and the other abutting fin 32A connects to the closing flake 34A through the connecting contacts and is C-shaped. The C-shaped abutting fin 32A has three slots 321A, and the closing flake 34A extends into the slots 321A.

The fastening part 40A has a through hole 41A, an accessory hole 43A, multiple abutting fins 42A, a closing flake 44A and multiple connecting contacts. The through hole 41A is formed through the body 10A. The abutting fins 42A are formed on an annular edge around the through hole 41A, are annularly arranged separately and surround the accessory hole 43A. The closing flake 44A is mounted pivotally in the accessory hole 43A. The connecting contacts are disposed between and connect respectively the closing flake 44A and the abutting fins 42A. One of the abutting fins 42A connects to the closing flake 44A directly, and the other abutting fins 42A connect to the closing flake 44A through the connecting contacts. In a preferred embodiment, the fastening part 40A has two abutting fins 42A, one of the abutting fins 42A connects to the closing flake 44A directly, and the other abutting fin 42A is C-shaped.

After the straw 60A is inserted into the straw part 30A, the C-shaped abutting fin 32A also can clamp tightly if the straw 60A is going to move upward. Therefore, the second embodiment can reach the same goal of preventing the straw 60A from slipping out easily.

Besides, the fastening part 40A also can keep the top end of the straw 60A in a sanitary condition when the straw 60A is inserted into the fastening part 40A. Nevertheless, the C-shaped abutting fin 42A can hold the straw 60A more tightly than the fastening part without the abutting fin in the first embodiment.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A straw-loosening-prevention lid comprising:
- a body;
- a straw part formed on the body and having
  - a through hole formed through the body;
  - multiple abutting fins formed on an annular edge around the through hole and annularly arranged separately;
  - a straw hole surrounded by the abutting fins;
  - a closing flake mounted pivotally in the straw hole; and
  - multiple connecting contacts disposed between and connecting respectively the closing flake and the abutting fins;
  - wherein one of the abutting fins connects to the closing flake directly, and the other abutting fins connect to the closing flake through the connecting contacts; and
- a fastening part, wherein the fastening part has
  - an accessory hole formed through the body and separate from the straw hole of the straw part;
  - a closing flake mounted pivotally in the accessory hole;
  - multiple connecting contacts disposed between and connecting respectively the closing flake of the fastening part and an annular edge around the accessory hole; and
- a connecting segment disposed between and connecting respectively the closing flake of the fastening part and the annular edge around the accessory hole; wherein the connecting segment is larger in volume than each connecting contact of the fastening part.

2. The straw-loosening-prevention lid as claimed in claim 1, wherein the abutting fins of the straw part incline downward toward the center.

3. The straw-loosening-prevention lid as claimed in claim 1, wherein the body has a spherical part formed on and protruding upward from a center of the body, and wherein the straw part is formed depressedly in the spherical part.

4. The straw-loosening-prevention lid as claimed in claim 2, wherein the body has a spherical part formed on and protruding upward from a center of the body, and wherein the straw part is formed depressedly in the spherical part.

5. The straw-loosening-prevention lid as claimed in claim 4, wherein the fastening part is formed depressedly in the spherical part.

6. A straw-loosening-prevention lid comprising:
- a body;

a straw part formed on the body and having a through hole formed through the body;

multiple abutting fins formed on an annular edge around the through hole and annularly arranged separately;

a straw hole surrounded by the abutting fins;

a closing flake mounted pivotally in the straw hole; and multiple connecting contacts disposed between and connecting respectively the closing flake and the abutting fins;

wherein one of the abutting fins connects to the closing flake directly, and the other abutting fins connect to the closing flake through the connecting contacts; and a fastening part, wherein the fastening part has a through hole formed through the body and separate from the through hole of the straw part;

multiple abutting fins formed on an annular edge around the through hole of the fastening part and annularly arranged separately;

an accessory hole surrounded by the abutting fins of the fastening part;

a closing flake mounted pivotally in the accessory hole; and multiple connecting contacts disposed between and connecting respectively the closing flake of the fastening part and the abutting fins of the fastening part;

wherein one of the abutting fins of the fastening part connects to the closing flake of the fastening part directly, and the other abutting fins of the fastening part connect to the closing flake of the fastening part through the connecting contacts of the fastening part.

7. The straw-loosening-prevention lid as claimed in claim 6, wherein the straw part has two abutting fins, one of the two abutting fins connects the closing flake directly and the other abutting fin is C-shaped.

8. The straw-loosening-prevention lid as claimed in claim 3, wherein the straw part has two abutting fins, one of the two abutting fins connects the closing flake directly and the other abutting fin is C-shaped.

9. A straw-loosening-prevention lid comprising:

a body; and a straw part formed on the body and having a through hole formed through the body;

two abutting fins formed on an annular edge around the through hole and annularly arranged separately;

a straw hole surrounded by the abutting fins;

a closing flake mounted pivotally in the straw hole; and multiple connecting contacts disposed between and connecting respectively the closing flake and the abutting fins;

wherein one of the two abutting fins connects to the closing flake directly, and another of the two abutting fins connect to the closing flake through the connecting contacts and is C-shaped; and wherein the C-shaped abutting fin of the straw part has a plurality of slots, and wherein the closing flake extends into the slots.

10. The straw-loosening-prevention lid as claimed in claim 7, wherein the C-shaped abutting fin of the straw part has a plurality of slots, and wherein the closing flake extends into the slots.

11. The straw-loosening-prevention lid as claimed in claim 6, wherein the fastening part has two abutting fins, one of the abutting fins of the fastening part connects to the closing flake of the fastening part directly and the other abutting fin of the fastening part is C-shaped.

12. The straw-loosening-prevention lid as claimed in claim 10, wherein the fastening part has two abutting fins, one of the abutting fins of the fastening part connects to the closing flake of the fastening part directly and the other abutting fin of the fastening part is C-shaped.

13. The straw-loosening-prevention lid as claimed in claim 12, wherein the abutting fins of the straw part incline downward toward the center.

14. The straw-loosening-prevention lid as claimed in claim 13, wherein the body has a spherical part formed on and protruding upward from a center of the body, and wherein the straw part and the fastening part are formed depressedly in the spherical part.

15. The straw-loosening-prevention lid as claimed in claim 6, wherein the abutting fins of the straw part incline downward toward the center.

16. The straw-loosening-prevention lid as claimed in claim 6, wherein the body has a spherical part formed on and protruding upward from a center of the body, and wherein the straw part and the fastening part are formed depressedly in the spherical part.

* * * * *